US007094002B2

(12) United States Patent
Winkler

(10) Patent No.: US 7,094,002 B2
(45) Date of Patent: Aug. 22, 2006

(54) HOLDING APPARATUS FOR A DAM UNIT OF A DAM INSTALLATION AND A METHOD FOR HOLDING AND RAISING OR LOWERING SUCH A DAM UNIT

(75) Inventor: Stefan Winkler, Linz (AT)

(73) Assignee: VA Tech Hydro GmbH & Co., Vienna (AT)

( * ) Notice: Subject to any disclaimer, the term of this patent is extended or adjusted under 35 U.S.C. 154(b) by 4 days.

(21) Appl. No.: 10/420,761

(22) Filed: Apr. 23, 2003

(65) Prior Publication Data

US 2004/0005195 A1 Jan. 8, 2004

(30) Foreign Application Priority Data

Apr. 24, 2002 (AT) ..... A 634/2002

(51) Int. Cl.
*E02B 7/36* (2006.01)
*E02B 7/30* (2006.01)

(52) U.S. Cl. ..... 405/106

(58) Field of Classification Search ..... 405/103, 405/104, 105, 106
See application file for complete search history.

(56) References Cited

U.S. PATENT DOCUMENTS 282,400 A * 7/1883 Stoney ..... 405/106
1,968,743 A * 7/1934 Christoffersen ..... 405/90
3,996,750 A * 12/1976 Brcar ..... 405/104
4,143,990 A 3/1979 Atencio
4,289,971 A * 9/1981 Ueda ..... 290/52
6,543,968 B1 * 4/2003 Robinson ..... 405/270

FOREIGN PATENT DOCUMENTS

DE 19641862 4/1998

* cited by examiner

*Primary Examiner*—Michael Safavi

(57) ABSTRACT

Holding apparatus for supporting a dam unit, wherein the apparatus includes a frame structure including at least one support member. The at least one support member is arranged to support the dam unit when the dam unit is raised from a lowered position to a holding position. The at least one support member is at least one of detachably connected to the dam unit and removably engagable with the dam unit. The at least one support member essentially experiences compression forces when the dam unit is supported in a holding position. This abstract is neither intended to define the invention disclosed in this specification nor intended to limit the scope of the invention in any way.

43 Claims, 6 Drawing Sheets

HOLDING APPARATUS FOR A DAM UNIT OF A DAM INSTALLATION AND A METHOD FOR HOLDING AND RAISING OR LOWERING SUCH A DAM UNIT

CROSS-REFERENCE TO RELATED APPLICATIONS

The present application claims priority under 35 U.S.C. § 119 of Austrian Patent Application No. A634/2002, filed on Apr. 24, 2002, the disclosure of which is expressly incorporated by reference herein in its entirety.

BACKGROUND OF THE INVENTION

1. Field of the Invention

The present invention relates to an apparatus for holding a dam unit which can be raised and lowered. The dam unit can be, in particular a weir or a turbine generator module having a number of turbine generator units. These turbine generator units can be arranged alongside one another and/or one above the other. Such dam units are arranged between two fixed-position dam structures, in particular piers, of a dam installation for a liquid medium. The invention may have particular application in a weir installation on a waterway. The invention also provides for a method for holding and raising or lowering such a dam unit, and to an associated dam installation.

2. Discussion of Background Information

Dam installations in waterways generally have at least two fixed-position dam structures, such as piers, between which a dam unit is arranged. These dam units can be a gate, a weir, a flap, a turbine generator module having a number of turbine generator units which are arranged alongside one another and/or one above the other and are connected to one another. Such dam units make it possible to carry out the specific function of the dam installation, for example as a weir installation, as a level-controlled dam for maintaining a specific water level for ship movements, or as an irrigation dam etc. These dam units can generally be raised and lowered in order to make it possible to clear the waterway, particularly in emergency situations. This can occur, for example, in the event of a flood. For this purpose, such dam units are guided, via suitable guide devices (such as guide grooves in the piers and guide rollers on the dam unit) in the dam structures of the dam installation. The dam units can thus be raised and lowered via lifting devices which are provided on the dam installation. Cranes are typically used as the lifting devices.

Normally, a dam installation of the type just described comprises a number of dam structures which are arranged alongside one another, and a corresponding number of dam units. However, only one crane is generally utilized, for cost reasons. It is thus necessary to use apparatuses which allow the dam units to be held in a raised position without the aid of the crane.

In known installations of this type, bars are placed transversely underneath portions of the dam units. The bars are installed via the guide grooves in the pier, and the guide rollers of the dam units are allowed to rest on the bars. In this way, the dam units are held in a raised position. Such an arrangement of the bars has the disadvantage in that the bars are mainly subject to bending loads and need to be of an appropriately large size in order to support the heavy weights or loads of such dam units. Another disadvantage is that forces are introduced into the dam structure very close to the edge. This is because the guide devices are, of course, arranged at the edge of the dam structure. As a result, only small cross-sectional areas are available for withstanding the load. As such, the loads which can be transmitted using the bars are, in consequence, at best small.

SUMMARY OF THE INVENTION

The present invention provides for a holding apparatus for use with dam units of a dam installation, in which the disadvantages mentioned above can be avoided and which, furthermore, can be constructed and operated easily and cost-effectively.

The holding apparatus has a frame structure whose elements are essentially subjected only to tension and/or compression forces. The apparatus has at least one holding element by which the holding apparatus can be detachably connected to the dam unit.

The invention also provides for a method in which the dam unit can be raised by a lifting device, in particular a crane, from the lowered operating position to a holding position which is located above the operating position. According to this method, at least one holding apparatus, having a frame structure, is detachably connected to the dam unit. Once the lifting device has been removed, the dam unit can thereby be held automatically in the holding position by this holding apparatus.

In raising and lowering a dam unit, the dam unit can be connected to a lifting device in the holding position. At least one holding apparatus, having a frame structure, automatically holds the dam unit in this first holding position. The lifting device can then be released. The dam unit can thus be raised or lowered by the lifting device to the operating position or to a further holding position and, if necessary, at least one holding apparatus, having a frame structure, is connected to the dam unit. In this way, the dam unit can be automatically held in the desired position by the holding apparatus once the lifting device has been removed.

The frame-like configuration of the holding apparatus allows the apparatus to be made smaller. This is because the frame elements or members are very good at handling tension and compression forces. By arranging the frame elements so that they are subjected to only tension or compression forces, these members can have relatively small rod cross sections. Furthermore, for design reasons, the arm of the frame-like holding apparatus can be automatically pushed back from the edge of the dam structure toward the center, as a result of which even greater forces can be transmitted via the available dam cross section, which is in consequence larger.

A physically very simple, and thus advantageous refinement of the invention, can also be obtained by an embodiment of the holding apparatus which has two limbs. The ends of these limbs facing the dam unit can be connected to the dam unit by way of suitable holding elements. A holding apparatus of this type can be designed to be very simple, since the frame can function with only a compression rod and a tension rod.

An extremely simple holding element can be obtained if a frame element of the holding apparatus, for example a limb, can be moved into a supporting element. The support element can be, for example a recess, arranged on the dam unit. In this way, the frame element and the dam unit can be designed to be physically very simple.

A likewise simple and flexible holding unit can be obtained by utilizing a connecting piece which is mounted such that it can rotate and/or be displaced on an element of the holding apparatus. The connecting piece can be, for example, a limb. The limb can be arranged to move into a retaining device on the dam unit, and can be detachably connected to the dam unit. A holding element such as this can, once again, be produced in a physically very simple manner. Moreover, the attachment can be such that the limb can rotate and/or otherwise be displaced. In this way, the holding apparatus allows an extremely high degree of flexibility with regard to its ability to connect to the dam unit.

It is very particularly advantageous for the holding apparatus to be mounted on the dam structure via a mounting. This mounting can have the form of a pressure plate. A mounting of this type can absorb and introduce into the dam structures only pure normal forces (i.e., compression forces). Moreover, such an arrangement allows the mounting to be designed smaller.

Longitudinal forces could lead to displacement of the arm on the pressure plate (and should thus be dissipated in some way). Accordingly, this problem can be solved in an advantageous manner by using a second holding apparatus which is arranged symmetrically and which acts in the same way on the dam unit, but in the opposite direction. Such an arrangement has the result of canceling out the longitudinal forces. Furthermore, the use of a pressure plate in such an arrangement has the effect of allowing for a certain lateral compensation movement, owing to its lateral displacement capability.

The further the mounting of the holding apparatus is arranged in the area of the dam structure center, the greater are the forces which can naturally be transmitted via the dam structure. In this way, the available cross section on the dam structure is enlarged, as a result of which, no special reinforcing measures are required on the dam structure itself.

It is very particularly advantageous for the holding apparatus to be mounted such that it can be displaced essentially transversely with respect to the flow direction of the medium (e.g., water). It is also very particularly advantageous for the holding apparatus to be mounted such that it can (alternatively and/or additionally) pivot about an axis which is essentially parallel to the flow direction of the medium. This can allow the holding apparatus to be moved to virtually any desired position or positions using very simple arrangements. In this way, the holding process can be highly simplified.

The mounting and the holding apparatus itself can be highly advantageously designed to compensate for any position inaccuracies of the dam unit and/or holding apparatuses in the holding position. This allows the dam unit to be positioned only roughly by way of the crane. Any position inaccuracies can thus be compensated for automatically, irrespective of their type.

In order to improve the flexibility of the holding apparatus, it is advantageous to design the mounting for the holding apparatus, or the holding apparatus itself, to compensate for any position inaccuracies of the dam unit and/or of the holding apparatus in the holding position.

If a holding apparatus (i.e., one that is arranged on each of the two sides of the dam unit facing the dam structures) is displaced and/or pivoted in the direction of the dam unit and is connected to the dam unit, the holding forces can be introduced in equal parts via the holding devices into different dam structures. This means that the holding apparatuses can themselves be designed to be smaller, and also that the load on the dam structures can be reduced.

The holding apparatus according to the invention is used in a very particularly advantageous manner in a dam installation having a number of fixed-position dam structures. These can be, in particular, piers. A dam unit can thus be raised and lowered according to the invention. These dam units can be, in particular, a weir or a turbine generator module having a number of turbine generator units which are arranged alongside one another and/or one above the other being provided between at least two dam structures.

If the guide plane of the holding apparatus and the sliding or pivoting plane of the holding apparatus are arranged offset from one another, it can be ensured that the holding apparatus and the dam unit do not impede one another, particularly during raising or lowering of the dam unit.

In another embodiment of the invention, the sliding or pivoting plane of the holding apparatus is arranged such that it essentially coincides with the vertical center of gravity plane of the dam unit and transversely with respect to the flow direction of the medium. According to such an arrangement, none to very little tilting moments are caused about the lateral axis of the dam unit in the holding position, as a result of the dam units being held off-center. In this way, essentially only the holding apparatuses are loaded in the holding position, and the guide devices are not subjected to such loading.

It is furthermore highly advantageous for the holding apparatus to be moved to a waiting position by way of the mounting of the holding apparatus, at least during the raising or lowering of the dam unit. As such, the dam unit (and the waiting position thereof) can be raised or lowered without being impeded by the holding apparatus. This ensures that the dam unit and the holding apparatuses never impede one another during raising or lowering, which could lead to blocking of the dam installation, or even to damage to the dam installation.

A dam installation can be designed to be even more flexible if a number of holding positions are set as required. All that is necessary to do this is to provide a number of connecting devices on at least one side of the dam unit facing the dam structure. These holding apparatuses can be connected to the dam unit in a manner which allows the dam unit to be raised or lowered to different holding positions.

The invention also provides for a holding apparatus for supporting a dam unit, wherein the apparatus comprises a frame structure comprising at least one support member. The at least one support member is arranged to support the dam unit when the dam unit is raised from a lowered position to a holding position. The at least one support member is at least one of detachably connected to the dam unit and removably engagable with the dam unit. The at least one support member essentially experiences compression forces when the dam unit is supported in a holding position.

The dam unit may comprise one of a weir, a turbine generator module having a number of turbine generator units which are arranged alongside one another, and a turbine generator module having a number of turbine generator units which are arranged one above the other. The dam unit may be arranged between two fixed-position dam structures. The fixed-position dam structure may comprise one of piers of a dam installation for a liquid medium, and a weir installation on a waterway.

The frame structure may be arranged on one side of the dam unit, and wherein the apparatus may further comprise another frame structure arranged on another side of the dam unit wherein the other frame structure comprises at least one other support member arranged to support the dam unit when the dam unit is raised from a lowered position to a holding position, the at least one other support member being at least one of detachably connected to the dam unit and removably engagable with the dam unit, wherein the at least one other support member essentially experiences compression forces when the dam unit is supported in a holding position.

The holding apparatus may further comprise an additional support member that can be detachably connected to the dam unit via a holding element. The additional support member may essentially experience tension forces when the dam unit is supported in the holding position. The holding element may comprise a bolt. The at least one support member may comprise a first limb and the additional support member may comprise a second limb, the first limb being longer than the second limb. Each of the first and second limbs may be movably mounted.

The at least one support member may be movably mounted. The holding apparatus may further comprise a supporting element arranged on the dam unit, wherein the support element is adapted to receive the at least one support member. The supporting element may comprise a recess.

The holding apparatus may further comprise a connecting piece that is at least one of movably mounted, rotatably mounted and pivotally mounted. The dam unit may comprise a retaining device and the connecting piece may be adapted to be inserted into the retaining device. The retaining device may comprise a guide, and the connecting piece may be detachably connected to the guide of the dam unit. The connecting piece may comprise an elongated opening.

The holding apparatus may further comprise a mounting, wherein the frame structure is connected to the mounting. The holding apparatus may further comprise a mounting, wherein the frame structure is at least one of movably mounted and pivotally mounted to the mounting. The holding apparatus may further comprise a pressure plate, wherein the mounting is mounted to the pressure plate. The holding apparatus may further comprise a pressure plate, wherein the mounting is movably mounted to the pressure plate.

The frame structure may be movable in a direction that is essentially transverse with respect to a medium flow direction. The at least one support member may be mounted such that it can pivot about an axis which is essentially parallel to a medium flow direction.

The holding apparatus may further comprise a mounting adapted to compensate at least one of positional inaccuracies of the dam unit and a location of the holding position. The frame structure may be adapted to at least one of compensate for positional inaccuracies of the dam unit and a location of the holding position.

The invention also provides for a method of supporting a dam unit using the holding apparatus described above, wherein the method comprises raising the dam unit with a lifting device from the lowered position to the holding position, detachably connecting the at least one support member to the dam unit, and supporting the dam unit in the holding position with the at least one support member.

The method may further comprise disconnecting the lifting device. The method may further comprise at least one of pivoting the at least one support member in a direction of the dam unit, and moving the at least one support member in a direction of the dam unit.

The method may further comprise arranging another frame structure on another side of the dam unit wherein the other frame structure comprises at least one other support member arranged to support the dam unit when the dam unit is raised from a lowered position to a holding position, the at least one other support member being at least one of detachably connected to the dam unit and removably engagable with the dam unit, wherein the at least one other support member essentially experiences compression forces when the dam unit is supported in a holding position.

The method may further comprise at least one of pivoting the at least one support member and the at least one other support member in a direction of the dam unit, and moving the at least one support member and the at least one other support member in a direction of the dam unit.

The method may further comprise at least one of moving the frame structure along a plane that is offset from a plane that runs through a guiding device which guides the dam unit, and pivoting the frame structure along a plane that is offset from a plane that runs through a guiding device which guides the dam unit.

The method may further comprise at least one of moving the frame structure along a plane that generally coincides with a plane running through a center of gravity of the dam unit, and pivoting the frame structure along a plane that generally coincides with a plane running through a center of gravity of the dam unit.

The apparatus may further comprise a mounting and the method may further comprise at least one of adjusting position inaccuracies of the dam unit via the mounting, adjusting position inaccuracies of the frame structure via the mounting, compensating for position inaccuracies of the dam unit via the mounting, and compensating for position inaccuracies of the frame structure via the mounting.

The apparatus may further comprise a compensating device mounted to the frame structure and the method may further comprise at least one of adjusting position inaccuracies of the dam unit via the compensating device, adjusting position inaccuracies of the frame structure via the compensating device, compensating for position inaccuracies of the dam unit via the compensating device, and compensating for position inaccuracies of the frame structure via the compensating device.

The method may further comprise moving the dam unit to a waiting position.

The invention also provides for a method for raising, lowering and supporting a dam unit using the holding apparatus described above, wherein the method comprises raising the dam unit with a lifting device from the lowered position to the holding position, disconnecting the lifting device, detachably connecting the at least one support member to the dam unit, supporting the dam unit in the holding position with the at least one support member, disconnecting the at least one support member from the dam unit, and lowering the dam unit with the lifting device from the holding position to the lowered position.

The invention still further provides for a dam installation having a number of fixed-position dam structures, and comprising at least one holding apparatus as described above. The dam unit may be movably guided via guide devices. The guide devices may comprise guide rollers and guide grooves.

The dam installation may further comprise at least one of the frame structure being movable along a plane that is offset from a plane that runs through a guiding device which guides the dam unit, and the frame structure can pivot along a plane that is offset from a plane that runs through a guiding device which guides the dam unit.

The dam installation may further comprise at least one of the frame structure being movable along a plane that generally coincides with a plane running through a center of gravity of the dam unit, and pivoting the frame structure along a plane that generally coincides with a plane running through a center of gravity of the dam unit.

The dam installation may further comprise another frame structure arranged on another side of the dam unit wherein the other frame structure comprises at least one other support member arranged to support the dam unit when the dam unit is raised from a lowered position to a holding position, the at least one other support member being at least one of detachably connected to the dam unit and removably engagable with the dam unit, wherein the at least one other support member essentially experiences compression forces when the dam unit is supported in a holding position.

The invention also provides for a holding apparatus for supporting a dam unit, wherein the apparatus comprises a frame structure comprising a first support member and a second support member. The first and second support members are arranged to support the dam unit when the dam unit is raised from a lowered position to a holding position. Each of the first and second support members are at least one of detachably connected to the dam unit and removably engagable with the dam unit. The first support member essentially experiences compression forces when the dam unit is supported in a holding position. The second support member essentially experiences tension forces when the dam unit is supported in a holding position.

The invention also provides for a holding apparatus for supporting a dam unit, wherein the apparatus comprises a first frame structure arranged on one side of the dam unit. A second frame structure is arranged on another side of the dam unit. The first frame structure comprises a first support member and a second support member. The second frame structure comprises a first support member and a second support member. Each of the first and second support member is arranged to support the dam unit when the dam unit is raised from a lowered position to a holding position. Each of the first and second support member is at least one of detachably connected to the dam unit and removably engagable with the dam unit. The first support members essentially experience compression forces when the dam unit is supported in a holding position. The second support members essentially experience tension forces when the dam unit is supported in a holding position.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
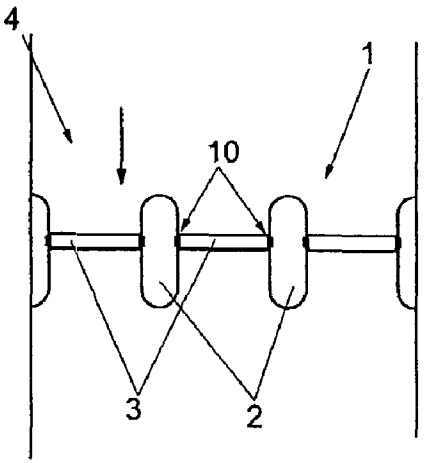
FIG. 1 shows schematically an arrangement of a prior art dam installation.

FIG. 1 shows a waterway 4 in which a dam installation 1 is arranged transversely with respect to the flow direction F, indicated by the arrow. This dam installation 1 essentially comprises fixed-position dam structures, in this case piers 2, and dam units 3. The dam units 3 are located between the piers 2, and are guided in guide devices 10 in the piers 2. The dam units 3 can be raised and lowered between the piers 2 by way of a crane, which is not illustrated. The dam units 3 may, in this case, be designed in any desired manner, for example as a gate, as a weir or else as a turbine generator module having a number of turbine generator units which are arranged alongside one another and/or one above the other in order to generate electrical power.

The dam units 3 are normally located in their completely lowered operating position. That is, they are supported on the base of the dam installation 1 by a part of the dam installation 1 itself for example the top of a weir W. In certain situations, for example, in the event of a flood or during maintenance work, these dam units 3 have to be raised from their operating position. The raised position can, in particular, be above the water level. Since only one crane is generally available in such installations, an apparatus must be provided by way of which the dam units 3 can be automatically held in a raised holding position so that the crane can be used elsewhere. This avoids unnecessarily blocking the crane.

A holding apparatus 5 according to the invention is illustrated in detail in FIGS. 2–6.

Figure 2:
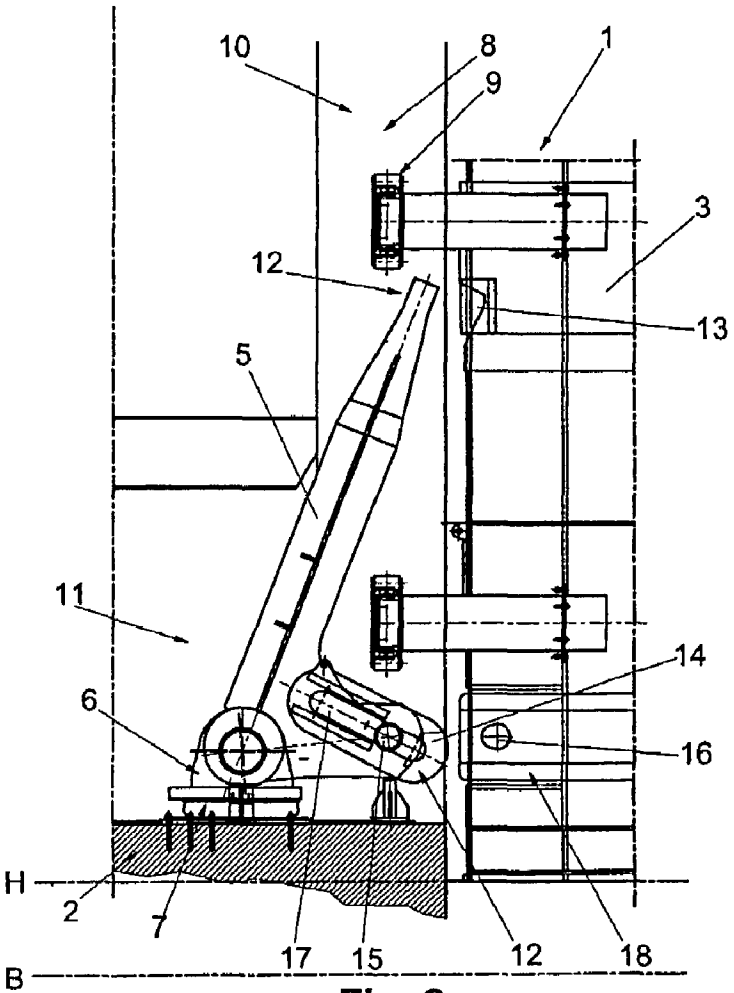
FIGS. 2 to 6 show the different positions of a holding apparatus according to the invention.

FIG. 2 shows a part of a dam unit 3 which is guided by a guide device 10 which includes guide rollers 9 and guide groove 8. A guide groove is arranged on each pier 2. Only one guide groove 8 of one pier 2 is shown. As in the prior art, the dam unit 3 of the dam installation 1 can be raised and lowered. The guide device 10 is, of course, provided on both sides of the dam unit 3. The dam unit 3 is located in a holding position H. The holding position H is a position wherein the dam unit 3 is raised above an operating position B, and is automatically held in this position by a holding apparatus 5. Although not shown, an equivalent holding apparatus 5 is, of course, also provided on the opposite side.

In the example shown in FIG. 2, the holding apparatus 5 has the form of a frame (whose parts can be made of metal such as, e.g., steel), with two limbs that form an L-shaped catch or member. The two limbs can absorb and transmit only tension and compression forces, owing to the configuration of the mounting 6 and of the holding elements 12 of the holding apparatus 5. In this specific example, the upper limb is a long limb that is designed to be a compression rod.

The short limb is the lower limb that is designed to be the tension rod. In order to provide this function, the holding apparatus 5 is mounted in the mounting 6 such that it can rotate and/or pivot. The mounting 6 is itself arranged on a pressure plate 7. In this way, normal forces, that is to say in this case only compression forces, can be transmitted to the pier 2 via the mounting 6 and the pressure plate 7. Since such piers 2 are generally formed as concrete structures and since, in practice, concrete can absorb only compression forces, this configuration and/or arrangement is extremely advantageous.

In such an arrangement, the transverse forces that occur can cancel one another out because of the symmetrical arrangement of the holding apparatuses 5, i.e., because they are arranged on opposite sides of the dam units 3. This ensures that the dam unit 3 is not displaced laterally, or is only displaced laterally to an insignificant extent. The pressure plate 7 may also, in this case, be designed such that it can be displaced transversely with respect to the flow direction in order to allow a better connection between the holding apparatus 5 and the dam unit 3. The holding apparatus 5 could thus be moved, not only in rotation, but also in translation transversely with respect to the flow direction. This would considerably improve the flexibility and ease of handling of the holding apparatus 5.

The mounting 6 and the holding apparatus 5 are in this case located in an niche 11 or recess in the pier 2. Depending on the configuration of the niche 11 and/or on a particular requirement, the holding apparatus 5 may also be partially or entirely pivoted, moved or otherwise displaced into the niche 11. The mounting 6 is adapted to compensate at least one of positional inaccuracies of the dam unit and a location of the holding position. The frame or frame structure that utilizes the two limbs is also adapted to at least one of compensate for positional inaccuracies of the dam unit and a location of the holding position. Thus, the mounting 6 and/or the frame structure functions as a compensating device.

Holding elements 12 are provided at each of the two ends of the limbs. These elements 12 allow the holding device 5 to be connected to the dam unit 3. In this example, a recess 13 (whose size and configuration is designed to receive the end of the limb) is provided on the dam unit 3. The recess 13 receives the end 12 of the upper long limb so that the upper limb can be latched to the dam unit 3.

In this embodiment, a bolt 15 is attached to the end of the short limb of the holding apparatus 5. This bolt 15 is likewise passed through a slot or an elongated hole 17 in a connecting piece 14. The connecting piece 14 can thus rotate freely about the bolt 15, and can be displaced freely along the elongated hole 17. In order to connect the holding apparatus 5 to the dam unit 3 via the short limb of the holding apparatus 5, the elongated hole 17 is made or moved to coincide with a hole 16 in the dam unit 3. Then, for example, a connecting bolt can be passed through these openings. In this way, the lower limb is connected to the dam unit in such a way that only pure tensile forces are transmitted via the short limb.

Figure 4:
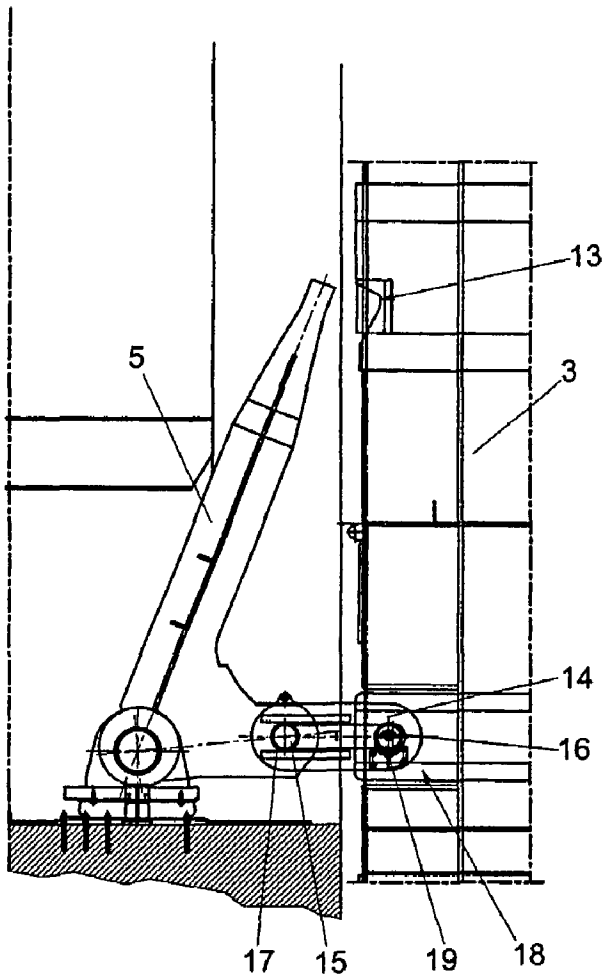
Figure 3:
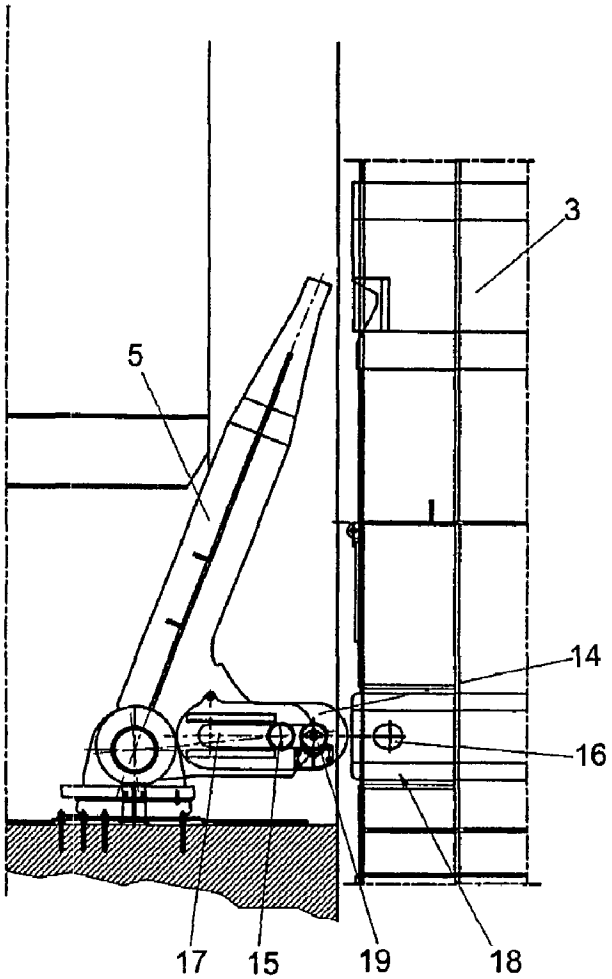
Figure 6:
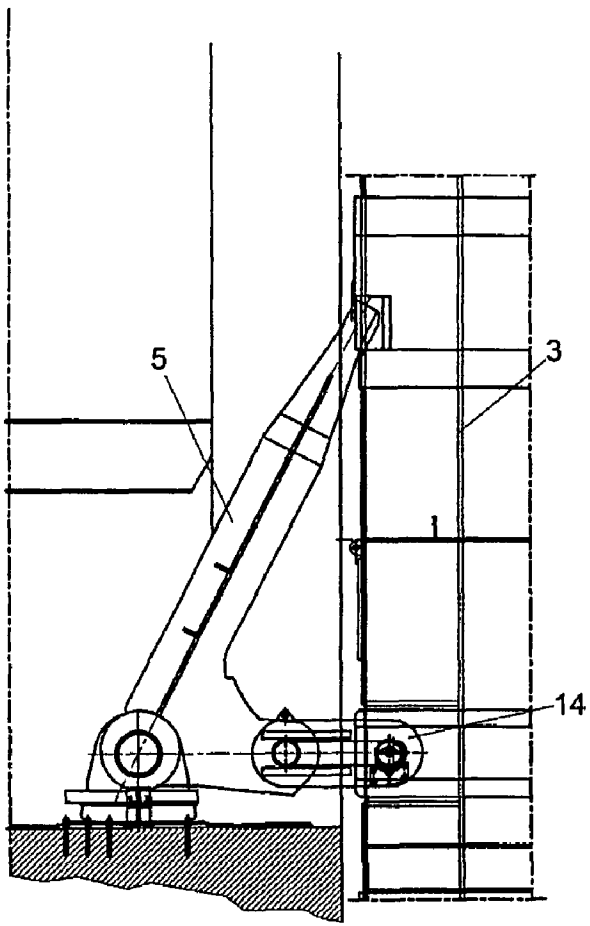
Figure 5:
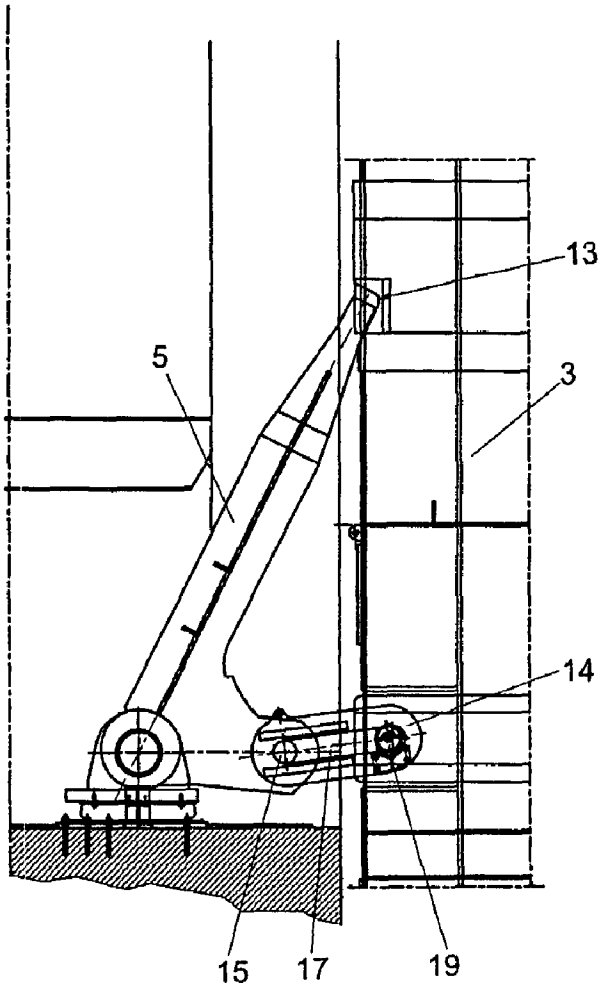

One example of a connection process will now be described with reference to FIGS. 2 to 6. FIG. 2 shows an initial position in which the holding apparatus 5 is folded or moved back and the connecting piece 14 in a rest or disengaged position. In FIG. 3, the connecting piece 14 has been folded or moved down to an essentially horizontal position. The dam unit 3 is, in this case, already located in a suitable holding position H. In FIG. 4, the connecting piece 14 has been displaced or moved generally horizontally along the elongated hole 17 in the direction of the dam unit 3. It then enters a fitting retaining device 18. This device 18 can be a recess formed in the dam unit 3. When the elongated hole 17 and an associated hole 16 in the dam unit 3 are coincident, a bolt 19 (or other equivalent connecting component) is passed through and is secured. Next, as is shown in FIG. 5, the holding apparatus 5 is pivoted in the direction of the dam unit 3 until the end of the long limb of the holding apparatus 5 comes to rest in the associated recess 13 in the dam unit 3. This movement causes or results in the connecting piece 14 being rotated (about bolt 19) to a certain extent. Such movement is possible without any problems due to the nature of the connection, i.e., due to the arrangement of the bolts 15, 19, the hole 16 and the elongated hole 17. The dam unit 3 is then lowered to a certain extent until the dam unit 3 is supported by the long limb in the recess 13, as shown in FIG. 6. The connecting piece 14 is, in consequence, rotated further and in this case reaches an approximately horizontal final position. As a result, only compression or tension forces are transmitted via the limbs of the holding apparatus 5. In this embodiment, neither of the holding elements 12 can transmit moments, for design reasons.

The end of the long limb can have an engaging surface that is generally parallel to the angled surface of the recess 13. This helps ensure that the long limb experiences only compressive forces.

The holding apparatus 5 can be released from the dam unit 3 essentially in the opposite sequence. Accordingly, this will not be described in detail here.

It should be noted that any other desired suitable holding elements 12, connecting pieces 14, and connection procedures appropriate for them, are contemplated by the invention and can be provided for the purposes of the invention. Accordingly, these are not described explicitly here.

Figure 7:
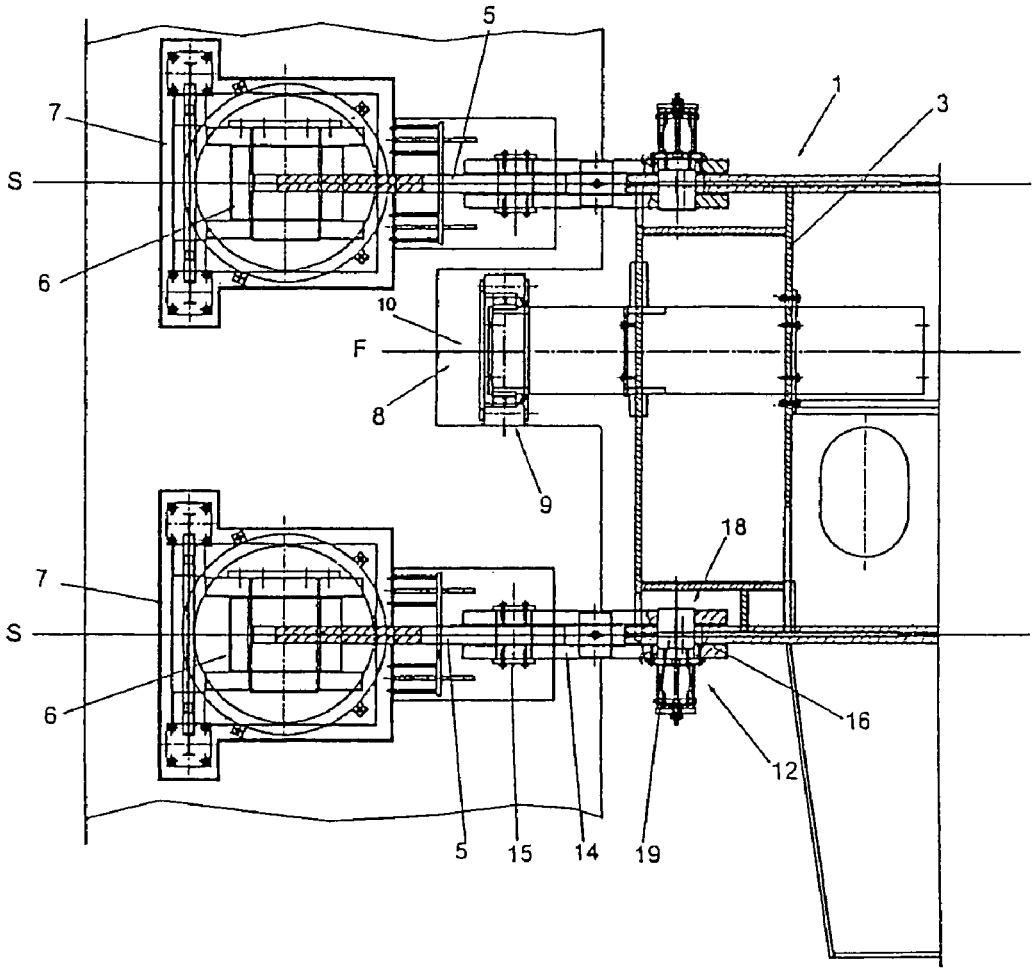
FIG. 7 shows a plan view of a holding apparatus according to the invention.

FIG. 7 shows a plan view of an embodiment similar to the one shown in FIGS. 2 to 5. In this example, two holding apparatuses 5 are arranged on each side of the dam unit 3 (only one side is shown). The two apparatuses 5 act together to hold or support each side of the dam unit 3 in the holding position H. Any tilting moments which may occur are, in consequence, absorbed by the holding apparatuses 5, so that there is little or no load on the guide devices 10. Furthermore, by using two holding apparatuses 5 (per side) instead of only one (per side), the holding apparatuses 5 may be designed to be smaller. This is because the forces which need to be absorbed by the apparatuses 5 are, of course, halved, i.e., split between two apparatuses.

In the embodiment shown in FIG. 7, one apparatus 5 is arranged on one side of the guide groove 8 and another apparatus 5 is arranged on the other side of the guide groove 8. Of course, the other side of the dam unit 3 would also have two apparatuses 5 arranged in a similar, but opposite facing configuration.

Figure 8:
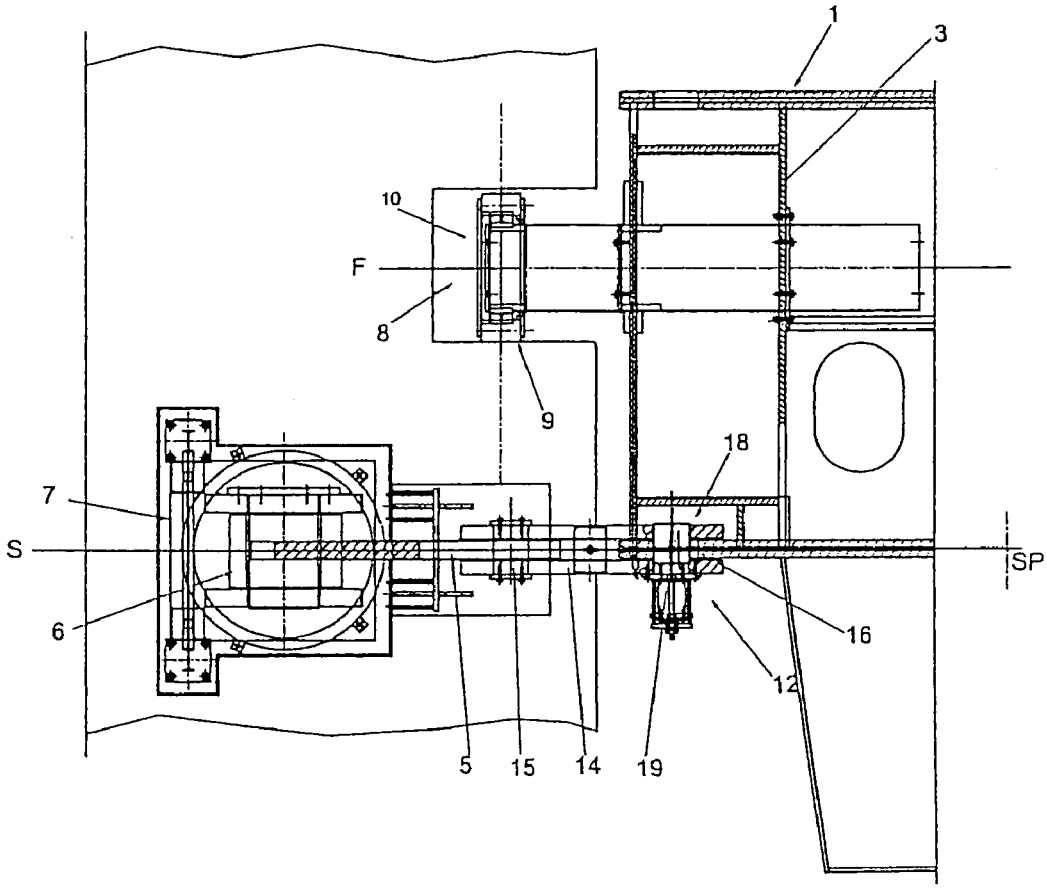
FIG. 8 shows a plan view of another holding apparatus according to the invention.

FIG. 8 shows another embodiment. In this example, only one holding apparatus 5 is provided on each side of the dam unit 3. This view shows particularly clearly, the offset position of the pivoting or sliding plane S of the holding apparatus 5. This plane S is arranged offset with respect to the guide plane F, which is defined essentially by the position of the guide device 10, i.e., guide rollers 9 and a guide groove 8. The pivoting and/or sliding plane S of the holding apparatus 5 is best located such that it runs generally or approximately through the center of gravity SP of the dam unit 3. This is preferred because it can prevent tilting moments from occurring on the dam unit 3. As a result, such tilting moments need not be absorbed by the guide devices 10 in the holding position H. Furthermore, this offset arrangement has the advantage that the holding apparatus 5 and the guide devices 10 do not impede one another during raising or lowering.

The operation of the holding apparatus 5 will now be described briefly. In the initial position, the dam unit 3 is located in its operating position B between two piers 2 on a dam installation 1. The dam unit 3 is designed to be moved to a raised position for certain reasons (for example because of a flood or for maintenance purposes). Preferably, the dam unit 3 is raised to a position in which the dam unit 3 is located above the water level. For this purpose, a lifting device is connected (via suitable devices) to the dam unit 3. Using the lifting device, the dam unit 3 can be raised to the approximate holding position H (see FIG. 2). In this holding position H, two holding apparatuses 5, for example, one on each side of the dam unit 3, are displaced and/or pivoted in the direction of the dam unit 3 and are detachably connected to it by way of holding elements 12 (see FIGS. 3–6). The holding apparatuses 5 can be, in this case, designed such that certain position inaccuracies can be compensated for automatically. For example the limbs of the holding apparatuses 5 themselves, the mounting of the holding apparatuses 5, or else the connecting pieces 14 could allow certain compensation movements, i.e., the movements or lengths of these devices can be made to be adjustable. Once the detachable connections have been produced, the lifting device can be detached or disconnected from the dam unit 3. Then, the dam unit 3 can be automatically held in the holding position H using the holding apparatuses 5. The same process steps are essentially carried out in the opposite sequence in order to lower the dam unit 3 from the holding position H to the operating position B.

If a number of holding elements 12 (and possibly recesses 13 located at different vertical heights) are provided on the apparatus 5 (e.g., by using a number of apparatuses 5 arranged at different vertical positions), it is, of course, also possible to move the dam unit 3 to different holding positions H as required, with the procedure essentially being carried out as described above.

It would likewise also be feasible to use pneumatic or hydraulic lifting drives integrated in the dam units 3 or in the dam structures instead of a crane as lifting apparatuses, although the fundamental function of the holding apparatuses 5 would, of course, remain the same.

Figure 9A:
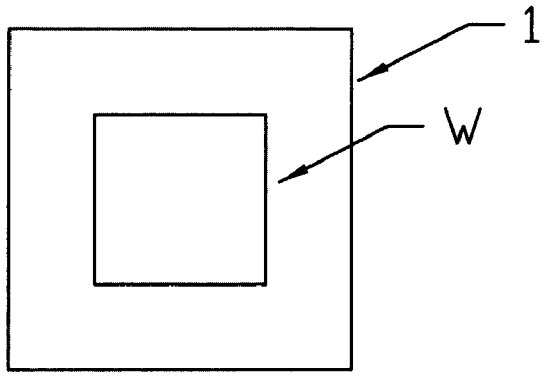
FIG. 9A schematically illustrates a dam unit that includes weir W.
Figure 9B:
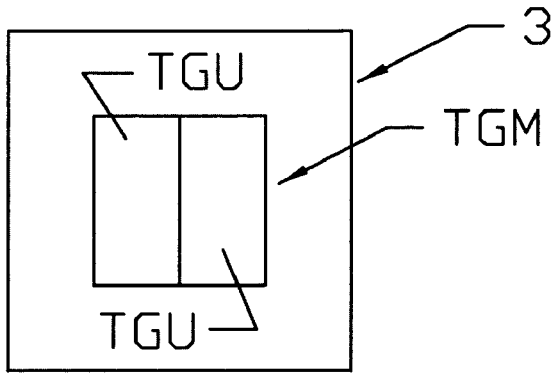
FIG. 9B schematically illustrates a dam unit that includes a turbine generator module with side by side turbine generator units.
Figure 9C:
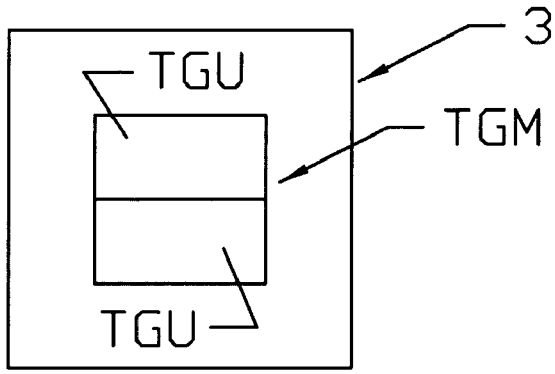
FIG. 9C schematically illustrates a dam unit that includes a turbine generator module with turbine generator units arranged one above the other.

FIG. 9A schematically illustrates a dam installation 1 that includes weir W. FIG. 9B schematically illustrates a dam unit 3 that includes a turbine generator module TGM with side by side turbine generator units TGU. FIG. 90 schematically illustrates a dam unit 3 that includes a turbine generator module TGM with turbine generator units TGU arranged one above the other.

It is noted that the foregoing examples have been provided merely for the purpose of explanation and are in no way to be construed as limiting of the present invention. While the present invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

What is claimed:

1. A holding apparatus for supporting a dam unit, the apparatus comprising:

a frame structure movably mounted to a surface via a mounting and comprising at least one support member and at least another support member;

the at least one support member and the at least another support member being arranged to support the dam unit when the dam unit is raised from a lowered position to a holding position; and the at least one support member and the at least another support member being at least one of detachably connected to the dam unit and removably engagable with the dam unit, wherein the at least one support member essentially experiences compression forces when the dam unit is supported in a holding position.

2. The holding apparatus of claim 1, further comprising one of:

the holding apparatus in combination with a weir;

the dam unit comprising a turbine generator module having a number of turbine generator units which are arranged alongside one another; and the dam unit comprising a turbine generator module having a number of turbine generator units which are arranged one above the other.

3. The holding apparatus of claim 1, wherein the dam unit is arranged between two fixed-position dam structures.

4. The holding apparatus of claim 3, wherein the fixed-position dam structures comprise one of:

piers of a dam installation for a liquid medium; and a weir installation on a waterway.

5. The holding apparatus of claim 1, wherein the frame structure is arranged on one side of the dam unit, and wherein the apparatus further comprises:

another frame structure arranged on another side of the dam unit wherein the other frame structure comprises at least one other support member arranged to support the dam unit when the dam unit is raised from a lowered position to a holding position, the at least one other support member being at least one of detachably connected to the dam unit and removably engagable with the dam unit, wherein the at least one other support member essentially experiences compression forces when the dam unit is supported in a holding position.

6. The holding apparatus of claim 1, wherein the at least another support member is detachably connected to the dam unit via a holding element.

7. The holding apparatus of claim 6, wherein the at least another support member essentially experiences tension forces when the dam unit is supported in the holding position.

8. The holding apparatus of claim 1, wherein the frame structure is adapted to at least compensate for positional inaccuracies of the dam unit or is adapted to at least compensate for a location of the holding position.

9. The holding apparatus of claim 6, wherein the at least one support member comprises a first limb and wherein the at least another support member comprises a second limb, the first limb being longer than the second limb.

10. The holding apparatus of claim 9, wherein each of the first and second limbs are movably mounted.

11. The holding apparatus of claim 1, wherein the at least one support member is movably mounted.

12. The holding apparatus of claim 11, further comprising a supporting element arranged on the dam unit, wherein the supporting element is adapted to receive the at least one support member.

13. The holding apparatus of claim 12, wherein the supporting element comprises a recess.

14. The holding apparatus of claim 1, further comprising a connecting piece that is at least one of movably mounted, rotatably mounted and pivotally mounted.

15. The holding apparatus of claim 14, wherein the dam unit comprises a retaining device and wherein the connecting piece is adapted to be inserted into the retaining device.

16. The holding apparatus of claim 15, wherein the retaining device comprises a guide, and wherein the connecting piece is detachably connected to the guide of the dam unit.

17. The holding apparatus of claim 14, wherein the connecting piece comprises an elongated opening.

18. The holding apparatus of claim 1, wherein the frame structure is movably connected to the mounting.

19. The holding apparatus of claim 18, wherein the frame structure is at least one of movably mounted and pivotally mounted to the mounting.

20. The holding apparatus of claim 1, further comprising a pressure plate, wherein the mounting is mounted to the pressure plate.

21. The holding apparatus of claim 1, wherein the mounting is adapted to compensate at least one of positional inaccuracies of the dam unit and a location of the holding position.

22. The holding apparatus of claim 1, wherein the frame structure is movable in a direction that is essentially transverse with respect to a medium flow direction.

23. The holding apparatus of claim 1, wherein the at least one support member is mounted such that it can pivot about an axis which is essentially parallel to a medium flow direction.

24. A dam installation having a number of fixed-position dam structures, and comprising at least one holding apparatus as recited in claim 1.

25. The dam installation of claim 24, wherein the dam unit is movably guided via guide devices.

26. The dam installation of claim 25, wherein the guide devices comprise guide rollers and guide grooves.

27. The dam installation of claim 24, further comprising at least one of:

the frame structure being movable along a plane that is offset from a plane that runs through a guiding device which guides the dam unit; and the frame structure pivoting along a plane that is offset from a plane that runs through a guiding device which guides the dam unit.

28. The dam installation of claim 24, further comprising at least one of:

the frame structure being movable along a plane that generally coincides with a plane running through a center of gravity of the dam unit; and pivoting the frame structure along a plane that generally coincides with a plane running through a center of gravity of the dam unit.

29. The dam installation of claim 24, wherein the frame structure is arranged on one side of the dam unit and further comprising:

another frame structure arranged on another side of the dam unit wherein the other frame structure comprises at least one third support member and at least one fourth support member arranged to support the dam unit when the dam unit is raised from a lowered position to a holding position, the at least one third and fourth support members being at least one of detachably connected to the dam unit and removably engagable with the dam unit, wherein the at least one third support member essentially experiences compression forces when the dam unit is supported in a holding position.

30. A method for supporting a dam unit using the holding apparatus of claim 1, wherein the method comprises:

raising the dam unit from the lowered position to the holding position;

detachably connecting the at least one support member and the at least another support member to the dam unit; and supporting the dam unit in the holding position with the at least one support member and the at least another support member.

31. The method of claim 30, further comprising at least one of:

pivoting the at least one support member in a direction of the dam unit; and moving the at least one support member in a direction of the dam unit.

32. The method of claim 30, further comprising:

arranging another frame structure on another side of the dam unit wherein the other frame structure comprises at least one third support member and at least one fourth support member arranged to support the dam unit when the dam unit is raised from a lowered position to a holding position, the at least one third and fourth support members being at least one of detachably connected to the dam unit and removably engagable with the dam unit, wherein the at least one third support member essentially experiences compression forces when the dam unit is supported in a holding position.

33. The method of claim 32, further comprising at least one of:

pivoting the at least one support member and the at least one third support member in a direction of the dam unit; and moving the at least one support member and the at least one third support member in a direction of the dam unit.

34. The method of claim 30, further comprising at least one of:

moving the frame structure along a plane that is offset from a plane that runs through a guiding device which guides the dam unit; and pivoting the frame structure along a plane that is offset from a plane that runs through a guiding device which guides the dam unit.

35. The method of claim 30, further comprising at least one of:

moving the frame structure along a plane that generally coincides with a plane running through a center of gravity of the dam unit; and pivoting the frame structure along a plane that generally coincides with a plane running through a center of gravity of the dam unit.

36. The method of claim 30, wherein the method further comprises at least one of:

adjusting position inaccuracies of the dam unit via the mounting;

adjusting position inaccuracies of the frame structure via the mounting;

compensating for position inaccuracies of the dam unit via the mounting; and compensating for position inaccuracies of the frame structure via the mounting.

37. The method of claim 30, wherein the mounting or the frame structure functions as a compensating device and wherein the method further comprises at least one of:

adjusting position inaccuracies of the dam unit;

adjusting position inaccuracies of the frame structure;

compensating for position inaccuracies of the dam unit; and compensating for position inaccuracies of the frame structure.

38. The method of claim 30, further comprising:

moving the dam unit to a waiting position.

39. A method for raising, lowering and supporting a dam unit using the holding apparatus of claim 1, wherein the method comprises:

raising the dam unit from the lowered position to the holding position;

detachably connecting the at least one support member and the at least another support member to the dam unit;

supporting the dam unit in the holding position with the at least one support member and the at least another support member;

disconnecting the at least one support member and the at least another support member from the dam unit; and lowering the dam unit from the holding position to the lowered position.

40. A holding apparatus for supporting a dam unit, the apparatus comprising:

a frame structure comprising at least one support member and at least another support member;

the at least one support member and the at least another support member being arranged to support the dam unit when the dam unit is raised from a lowered position to a holding position; and the at least one support member and the at least another support member being at least one of detachably connected to the dam unit and removably engagable with the dam unit, wherein the at least one support member essentially experiences compression forces when the dam unit is supported in a holding position, wherein the at least another support member is detachably connected to the dam unit via a holding element, and wherein the holding element comprises a bolt.

41. A holding apparatus for supporting a dam unit, the apparatus comprising:

a frame structure comprising at least one support member and at least another support member;

the at least one support member and the at least another support member being arranged to support the dam unit when the dam unit is raised from a lowered position to a holding position;

the at least one support member and the at least another support member being at least one of detachably connected to the dam unit and removably engagable with the dam unit, a mounting; and a pressure plate, wherein the mounting is movably mounted to the pressure plate, wherein the frame structure is connected to the mounting, and wherein the at least one support member essentially experiences compression forces when the dam unit is supported in a holding position.

42. A holding apparatus for supporting a dam unit, the apparatus comprising:

a frame structure arranged on one side of the dam unit and comprising a first support member and a second support member;

the first and second support members being arranged to support the dam unit when the dam unit is raised from a lowered position to a holding position; and each of the first and second support members being at least one of detachably connected to the dam unit and removably engagable with the dam unit, wherein the first support member essentially experiences compression forces when the dam unit is supported in a holding position, and wherein the second support member essentially experiences tension forces when the dam unit is supported in a holding position.

43. A holding apparatus for supporting a dam unit, the apparatus comprising:

a first frame structure arranged on one side of the dam unit;

a second frame structure arranged on another side of the dam unit;

the first frame structure comprising a first support member and a second support member;

the second frame structure comprising a first support member and a second support member;

each of the first and second support members being arranged to support the dam unit when the dam unit is raised from a lowered position to a holding position; and each of the first and second support members being at least one of detachably connected to the dam unit and removably engagable with the dam unit, wherein the first support members essentially experience compression forces when the dam unit is supported in a holding position, and wherein the second support members essentially experience tension forces when the dam unit is supported in a holding position.

* * * * *